United States Patent [19]

Arnemann

[11] Patent Number: 4,979,350

[45] Date of Patent: Dec. 25, 1990

[54] DEVICE FOR THE SCREWING IN AND THE SCREWING OUT OF SCREW CAPS ETC. INTO OR OUT OF THE FILLER NECKS OF BARRELS, CONTAINERS, ETC.

[76] Inventor: Gerhard Arnemann, Am Krönrey 11, D-2083 Halstenbek, Fed. Rep. of Germany

[21] Appl. No.: 137,404

[22] Filed: Dec. 23, 1987

[30] Foreign Application Priority Data

Sep. 9, 1987 [EP] European Pat. Off. ..... 87113912.7

[51] Int. Cl.[5] ..... B65B 7/28

[52] U.S. Cl. ..... 53/331.5; 53/317; 53/367; 53/381 A

[58] Field of Search ..... 53/109, 317, 331.5, 53/367, 381 A

[56] References Cited

U.S. PATENT DOCUMENTS

| | | | |
|---|---|---|---|
| 2,731,185 | 1/1956 | Ranney | 53/367 X |
| 2,983,089 | 5/1961 | Reese | 53/317 X |
| 3,955,341 | 5/1976 | Wilhere | 53/367 X |
| 4,497,155 | 2/1985 | Grosskreoz | 53/367 |

FOREIGN PATENT DOCUMENTS

| | | |
|---|---|---|
| 1817237 | 8/1969 | Fed. Rep. of Germany . |
| 2210753 | 9/1972 | Fed. Rep. of Germany . |
| 2540864 | 3/1977 | Fed. Rep. of Germany . |

*Primary Examiner*—John Sipos

*Attorney, Agent, or Firm*—Stanger, Michaelson, Reynolds, Spivak & Tobia

[57] ABSTRACT

A device for applying and removing threaded caps to and from threaded filler necks of containers includes a centering device, a rotatable grasping member mounted within the centering device for grasping a cap and turning the cap to thread it relative to the filler neck, a driver within the centering device for rotating the grasping member, and a resilient arrangement in a frame to resiliently hold the centering device relative to the frame and permit the centering device to move axially and radially relative to the frame. The frame and the centering device have sufficient clearance between them to permit axial and radial movement of the entering device relative to frame.

15 Claims, 4 Drawing Sheets

DEVICE FOR THE SCREWING IN AND THE SCREWING OUT OF SCREW CAPS ETC. INTO OR OUT OF THE FILLER NECKS OF BARRELS, CONTAINERS, ETC.

The present invention relates to a device intended for barrels, containers, etc., for the screwing in and screwing out of screw caps, etc., of plastic or metallic materials into or out of the inner thread of a filler neck secured to the barrel or container cover plate within the area of an opening provided in the upper cover plate of the barrel, container, etc., with a filling aperture, the rim of which delimits and extends circumferentially around the upper filling aperture and is provided with a rim bead located on the outside possessing a mounting rim lying in the plane of the upper filling aperture of the filler neck and which extends circumferentially around said aperture of the filler neck, to which an approximately circular section is joined that passes into the outer wall of the filler neck, while use is made of a centering and screwing head consisting of an outer centering member mountable on the filler neck and a wrench disposed within the inner space of the same which is displaceable by spring pressure and which can be turned with the aid of a drive means and which engages into the screw cap or the like.

BACKGROUND OF THE INVENTION

It is known that barrels and containers that are to be filled with liquids are delivered with screwed-on caps or screwed-in plugs, it thus becoming necessary to remove these closure means and to screw these on again subsequent to the filling operation. In order to ensure that when the recipient is filled, the liquid it is to be filled with runs into the filling aperture of the barrel and not beside it onto the barrel top, the barrels to be filled are aligned inside a filling facility. The manual opening and closing of the filling apertures is labor-intensive. A closing apparatus is known for the closing of the filling aperture of a barrel or the like with the aid of a device for inserting and securing a plug in the filling aperture, in which both the device for inserting the plug as well as a position determining device are mounted in such a way at a distance from one another that they are freely movable upwardly and downwardly as well as according to polar coordinates with respect to a fixed point in a plane perpendicular to the upwardly and downwardly directed movement. In addition, in this known device, a gripping device is provided in order to prevent the joint unimpeded movement of the device for inserting the plug and determining the position, and a drive means which is suitable for displacing the two devices for inserting the plug and for determining the position when the gripping device prevents the unimpeded movement, solely linearily and, of necessity, by a distance which corresponds to the distance between the two devices. This closing apparatus has very large dimensions. In order to achieve an adequate strength and the exact structural support for the mobile components, the construction is very expensive. Moreover, the power requirement for operating this closing apparatus is very great since, when performing the centering operation, the entire frame has always to be swivelled on the supporting device by one axis (DE-A-18 17 237).

According to the U.S. Pat. No. 2,983,089, a cover closing and recipient-filling apparatus is known, the construction of which is very expensive and which consequently is very awkward to operate.

Furthermore, through the DE-A-22 10 753, an apparatus for closing recipients with an excentrically arranged spout is known, the closing operation being effected with the aid of a driving mechanism, which mechanism can be displaced between a rest position and an operative position, in which a centering device carried by this driving mechanism engages into the periphery of the cover plate of the recipient which is provided with an eccentric spout in such a way that a rotatable output shaft of the driving mechanism is brought into a position that is coaxial to the recipient and is retained in the same, by a scanning device held excentrically by the shaft and which, as part of this shaft, is displaceable with the same by one circumference, the center point of which is located on the axis of the recipient and the radius of which is equal to the distance between the axis of the spout and the axis of the recipient, up to an engagement position with the spout, and which is characterized by a closing head which is maintained excentrically by the shaft in a position coaxial to the scanning facility and which is displaceable along its own axis between a rest position and an operative position, in which an engagement with the spout takes place. With the aid of this apparatus, the closing of recipients having eccentric spouts is possible, the scanning of the spout position being effected by means of a device which facilitates and expedites this scanning operation while, at the same time, it is intended to achieve with the aid of a further device that the entire operating cycle of the apparatus proceeds entirely automatically. In order to carry out all these functions, this known apparatus possesses a plurality of complicated components.

Through the DE-A-25 40 864, an apparatus for securing screw caps or screwed plugs in the filler neck apertures of barrels is known with a cantilever which, with the aid of a lifting means, is vertically displaceable and can be swivelled around a vertical axis and is provided with both a centering as well as a closing device which, by the swivelling of the cantilever, can be successively brought above the filler neck aperture of a barrel. This apparatus is constructed in such a way that the centering device is detachably connected to the cantilever by means of a receiving flange and in that, on the receiving flange, a retaining tube with joints for detector or locator fingers constructed on the tube outer wall is provided, the shanks of which being passed through openings in the retaining tube shell and can be held together by means of an elastic ring of rubber or the like and the surface sections of which that face away from the retaining tube are configured increasingly spherically to the center axis of the retaining tube with guide pilots arranged coaxially to the retaining tube, wherein, axially to the retaining tube, through an opening provided in the receiving flange, by means of a pneumatically or hydraulically functioning lifting cylinder, a centering mandrel can be displaced vertically up to the abutment on the shanks of the detector fingers and, moreover, in the closing device, a suction head for lifting the barrel closing covers by suction and a screwing head for screwing on the barrel cover plates onto the thread of the barrel filler neck provided in the filler neck aperture are disposed at the one terminal section of a receiving pipe, the other terminal section of which is rigidly connected to a drive shaft. With an apparatus constructed in this manner it is supposed to be possible, not only to place the closing cover onto the filler neck aperture and to screw the same on after a barrel has been filled, but without using the long threaded spindles or the like which are expensive to manufacture, to effect the in each case requisite movement and power transmission operations by means of hydraulically or pneumatically operating control members so that it is possible to transmit great forces even with small models.

In addition, from the U.S. Pat. No. 2,731,185, a plug screwing in apparatus with a centering and screwing head is known which consists of an outer centering ring and a screwing head which is displaceable therein against spring pressure, the same being connected by means of a drive shaft with angularly movable joints to a drive means. In this plug screwing in apparatus, the centering ring is constructed and sectionally configured in such a way that, when screwing a plug into the barrel filling aperture, it is supported on the upper and circumferentially extending rim of the filler neck and, for this reason, has to be adapted to the dimensions and the diameter of the barrel filling aperture. This centering ring cannot be used for barrel filling apertures having different dimensions. Added to this is the circumstance that the drive shaft for the screwing head is provided with angularly movable joints which consist of disk-like shaped members disposed on the extremities of the drive shaft arranged inside compartment-like bearing boxes in the form of spherical segmental coupling means with an arcuately shaped and circumferentially extending outer wall surface, wherein the spherical segmental coupling means is supported with the aid of a ball bearing on a spring-biased cylindrical shaped member in order to be able to carry out sliding movements as well. The employment of a drive shaft supported at both extremities by means of spherical segmental coupling means calls for an expensive and complicated construction which is susceptible to trouble and which does not allow the production of the plug screwing in apparatus with small dimensions. Moreover, the spherical segmental coupling means is incapable of executing large angular movements. In the event of a fouling of the bearing boxes for the spherical segmental coupling means, a serious impairment of the angular movements of the joints will ensue. In addition, a drive shaft possessing angularly movable joints at both extremities only and which is supported by means of these joints, does not possess any elevated torsional rigidity, so that when a plug is screwed into a badly fouled or rusted filling aperture of a barrel, distortions of the drive shaft may be the result.

Furthermore, through the EP-A-065180, a plug screwing in apparatus for barrels is known with a centering and screwing head, consisting of an outer centering ring and a screwing head disposed in its interior which is displaceable by spring pressure and which is connected to a drive means having angularly movable joints. This screwing in apparatus for plugs consists of a supporting frame with an upper supporting plate and a lower supporting plate, upon which a centering plate is arranged which is provided with a cruciform aperture and, in the inner wall surface of which delimiting the aparture, tapers conically in the direction of the centering and screwing head and which, at the bottom, passes into a vertical wall section, the internal diameter of the recess delimited by the wall section being larger than the diameter of the drive shaft, an accordingly sectionally configured shaped member with an outer wall surface tapering conically in the direction of the centering and screwing head is inserted into the aperture, with the shaped member carrying on its bottom end the centering ring supported on a barrel cover plate during the plug centering and screwing in operation and is connected to a section located on the centering plate with a guide plate that is retained on at least three guide bolts secured to the lower supporting plate of the supporting frame in a longitudinally displaceable manner and can be swivelled against spring pressures, and wherein the drive shaft comprises one shaft section connected to the drive means and one shaft section carrying the screwing head, both shaft sections being connected to one another by means of a double knuckle joint. With a screwing in unit for plugs constructed in this manner a fully automatic screwing in of plugs into the thread of the filler plug arranged on the filling aperture is supposed to be possible, wherein, besides an automatic centering, also a compensation for an inclination of the plug is supposed to take place. Due to the fact that this screwing in unit for plugs operates with a centering and screwing head which is provided with a conical centering surface, an inclination and thus a tilting of the screw plug is unavoidable, so that a perfect screwing on or screwing in of such screw plugs and screw caps into the thread of the barrel filler neck is not always ensured. If, due to damage, the filler neck is tilted relative to the barrel cover plate, i.e. is bent sideways, so that the longitudinal axis of the filler neck does not extend at a right angle to the plane of the barrel cover plate, then no adaptation to this special filler neck position is possible with this known screwing in unit for plugs since the centering and screwing head is incapable of adapting to this particular position despite its conical inner wall configuration.

The present invention solves the technical problem of providing a screw cap screwing in and screwing out device for barrels which not only automatically carries out a centering of the screwing head onto the filling aperture of the filler neck and a compensation if the screw cap is tilted, but which automatically aligns itself to the longitudinal axis of the barrel filler neck during the centering operation, even when the filler neck is bent sideward to the plane of the barrel cover plate or if it were to assume a tilted position, and in which the centering and screwing head is automatically returned from an inclined position into the vertical starting position and which, over and above this, renders a centering of high accuracy possible so that also screw caps provided with a fine thread can be screwed into the thread of the filler neck with a high degree of accuracy and without any difficulties.

SUMMARY OF THE INVENTION

This technical problem is solved by the features characterized in claim 1.

In addition, the invention provides a construction of the device for the screwing in and screwing out of screw caps, according to which the device consists of a vertical supporting arm capable of travelling perpendicularly, to which supporting arm a supporting frame is connected, of a guide cylinder which is passed through the supporting frame and which, on its top side, carries a drive means for the wrench, of a longitudinally displaceable, cylindrical hollow body retained within the inner space of the guide cylinder, a centering ring and a wrench having been constructed on the bottom of the hollow body which is disposed within the inner space of the cylindrical hollow body and which is connected to the drive shaft that is interconnected with the drive means and arranged within the inner space of the guide cylinder and of the cylindrical hollow body of the centering member, the guide cylinder being disposed within the inner space of the cylindrical coil spring surrounding the guide cylinder, this spring being supported at one of its ends on the supporting frame and, at its other end, on the freely moving guide cylinder carried in the supporting frame.

In addition, the invention provides a construction of the device for the screwing in and screwing out of screw caps, which is designed in such a way that, on the vertically displaceable perpendicular supporting arm, a supporting bracket is arranged as a supporting frame comprising an upper horizontal annular member and a lower horizontal annular member arranged at a distance from the same with the aid of preferably lateral spacer arms, that in the intercorresponding apertures of the two annular members of the supporting bracket, the guide cylinder is disposed so as to be swivellable around its longitudinal axis which, with a circumferentially extending outer ring adjacent to its bottom end is supported on the lower annular member and which is biased by the cylindrical coil spring surrounding the guide cylinder, said spring being supported at the bottom end on the outer ring of the guide cylinder and, within the upper area, on the upper annular member, the cylindrical coil spring being clamped between the upper annular member of the supporting bracket and the outer ring of the guide cylinder, that the guide cylinder, at its top end, supports, as drive means for the wrench, an air motor with two connections for controlling the screwing on and screwing off operations, or some other suitable drive means with a vertical drive shaft arranged within the inner space of the guide cylinder, which shaft can be rotated around its vertical longitudinal axis and which is longitudinally displaceable against the pressure of a cylindrical coil spring and which, on its lower end, is provided with the wrench that can be brought into operative connection with the screw cap, that within the inner space of the guide cylinder, a cylindrical hollow body is arranged which is longitudinally displaceable in the longitudinal direction of the guide cylinder against the pressure of a cylindrical coil spring and which, on its bottom end, carries the centering ring, the annular inner wall surface of which expands conically toward the free end on the bottom side, the upwardly conically tapering inner wall surface of the centering ring passes, in the form of a contact surface, on the circumferentially extending mounting rim of the annular rim bead of the filler neck into an upper horizontal annular section, to which is joined, with the interposition of a step-like section with a vertical and a horizontal annular surface, the inner wall surface of the cylindrical hollow body of the centering member, the inner space of which communicates with a vacuum-generating facility for picking up and retaining a screw cap on the wrench by means of a vacuum, and that the endwardly conically extending inner wall surface of the centering ring is dimensioned in such a way that when the centering ring is mounted on the barrel filler neck, or that of a container or the like, the outwardly located rim bead of the filler neck is overlapped.

In a device thus constructed for the screwing in and screwing out of screw caps, the centering and screwing head is retained in a vertically displaceable supporting frame in such a fashion by means of a cylindrical coil spring which surrounds the centering and screwing head, that the centering and screwing head can be pivoted around its longitudinal axis in such a way that the centering and screwing head is capable of aligning itself with its longitudinal axis to every longitudinal axis of the barrel filler neck and this independently of what angular position the longitudinal axis of the filler neck assumes relative to the longitudinal axis of the barrel or to the plane of the barrel cover plate. By supporting the centering and screwing head with the aid of a springily resilient member, more particularly a cylindrical coil spring, the centering and screwing head can be transferred into any angular position which deviates from the longitudinal axis of the barrel filler neck, or into any position which coincides with the position that arises from a longitudinal axis of the filler neck that deviates from the vertical with the filler neck bent upwardly relative to the cover plane of the barrel, container or the like, or which can be automatically reset from any angular position into the vertical position, so that the centering and screwing head can also be automatically returned from a tilting position into its vertical starting position by means of this springily resilient member. Consequently, an alignment to the respective longitudinal axis of the filler neck given at a time is always possible so that, after the alignment to the longitudinal axis of the filler neck has been effected, the screw cap can be screwed securely into the thread of the barrel filler neck. A secure screwing in of screw caps into the thread of filler necks is ensured even when fine threads are employed, so that the device according to the invention can, on principle, be ultimately used everywhere even where an aligning and centering for performing a screwing in or screwing our operation is necessary.

The exact centering on the filler neck of the barrel is assisted by the special construction of the inner wall of the centering ring which constitutes the outer centering member of the centering and screwing head. The inner wall surface of the centering ring is aligned to the rim configuration of the filler neck within the area of its filling aperture, so that by the interaction of this rim configuration with the configuration of the inner wall surface of the centering member, an extremely accurate centering is ensured not only for the screwing in operation, but for the screwing out operation as well.

Preferable embodiments of the invention are characterized in the subclaims.

BRIEF DESCRIPTION OF THE DRAWINGS

In the following the subject matter of the invention is explained in the drawings.

DETAILED DESCRIPTION OF THE PREFERRED EMBODIMENT

Figure 1:
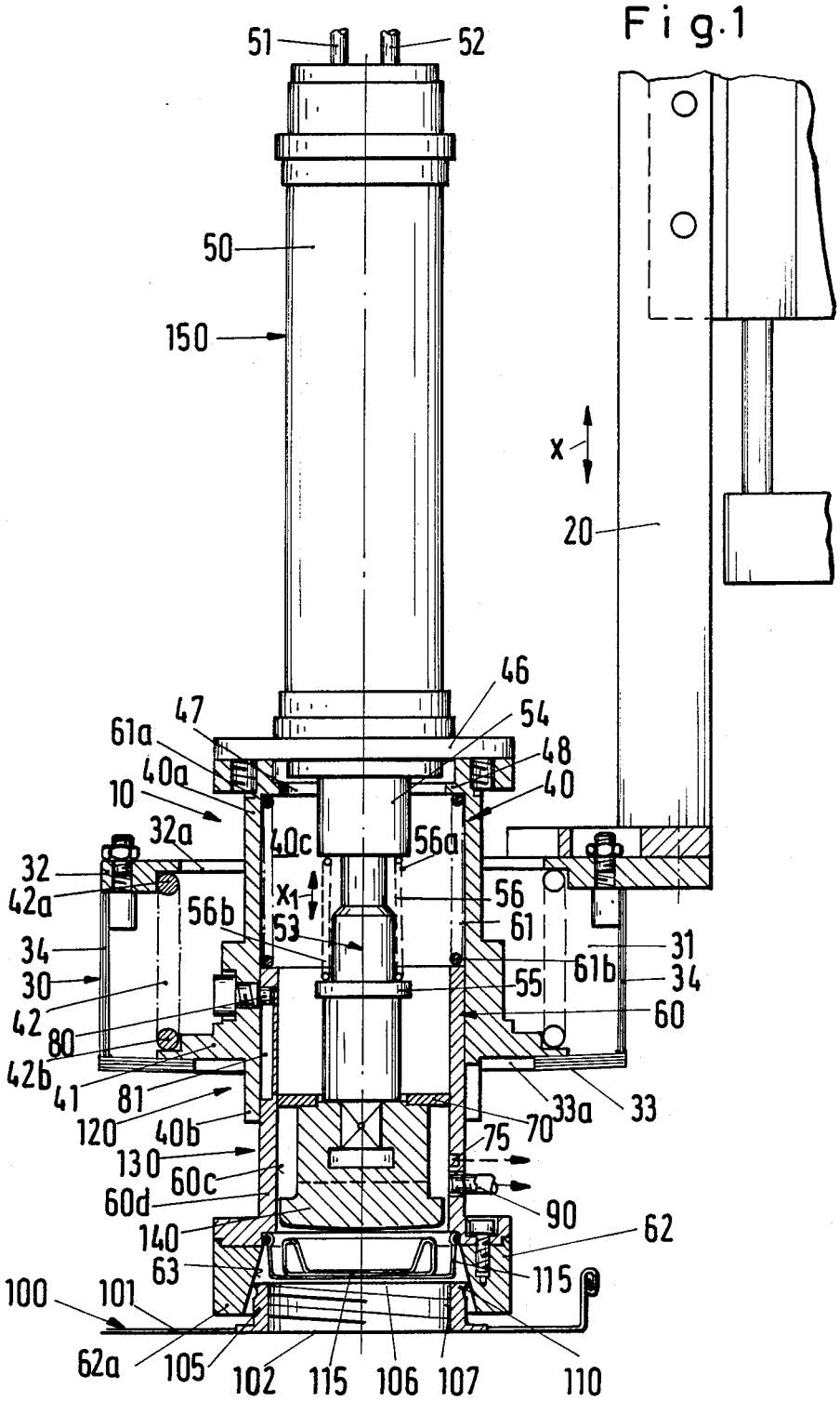
FIG. 1 shows, partly in a view and partly in a vertical section, the screwing in and screwing out device for screw caps.

The device identified with 10 in FIG. 1 is intended for the screwing in and the screwing out of screw caps 115 provided with threads into the inner threads of filler necks 105 of barrels and containers 100 or the like, which are provided with barrel filling aperture plugs or with filler necks 105. Apart from screw caps 115, it is also possible for different types of closure elements to be screwed into barrel filling apertures or screwed out of or screwed off from filling apertures with the aid of the device, it is essential, however, for said closure elements to be provided with threads.

In FIG. 1, at 100, a barrel, container or the like is outlined, the upper cover plate of which 101 is provided with an opening or with the filling aperture 102. Within the area of this aperture 102, a filler neck 105 is arranged on the barrel top cover plate 101, the filling aperture of which is indentified with 106. This filler neck 105 is provided with an inner thread 107. The rim 110 which delimits and circumferentially extends around the filling aperture 106 possesses an outwardly located annular rim bead 111 that is provided with a vertical mounting rim 112 lying within the plane of the filling aperture 106 of the filler neck 105, which rim is plane in construction. This mounting rim 112 passes into the outer wall 113 of the filler neck while forming a circular section 114 (FIG. 3).

Figure 2:
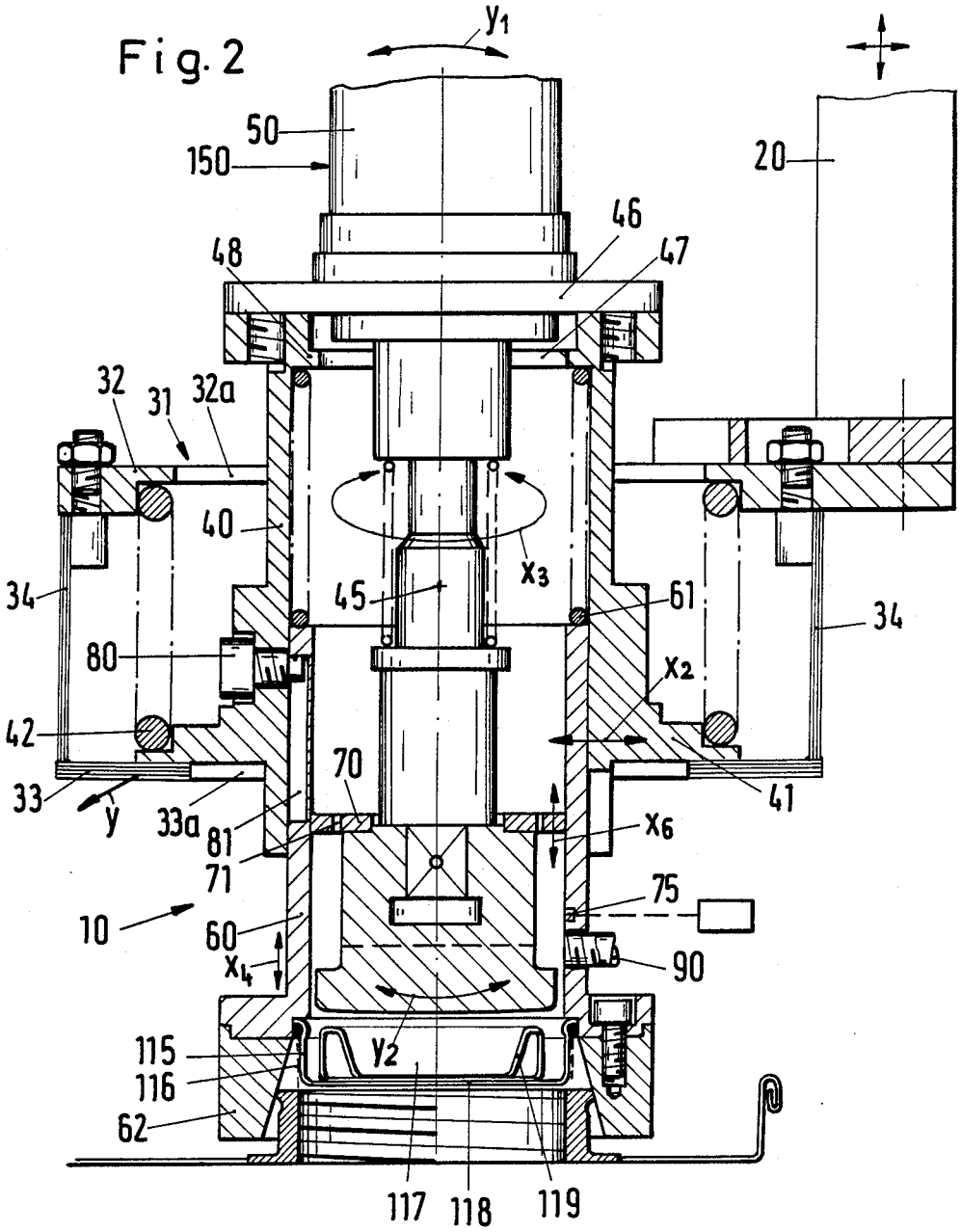
FIG. 2 shows, partly in a view and partly in a vertical section, an enlarged reproduction of the lower portion of the screwing in and screwing out device for screw caps.
Figure 3:
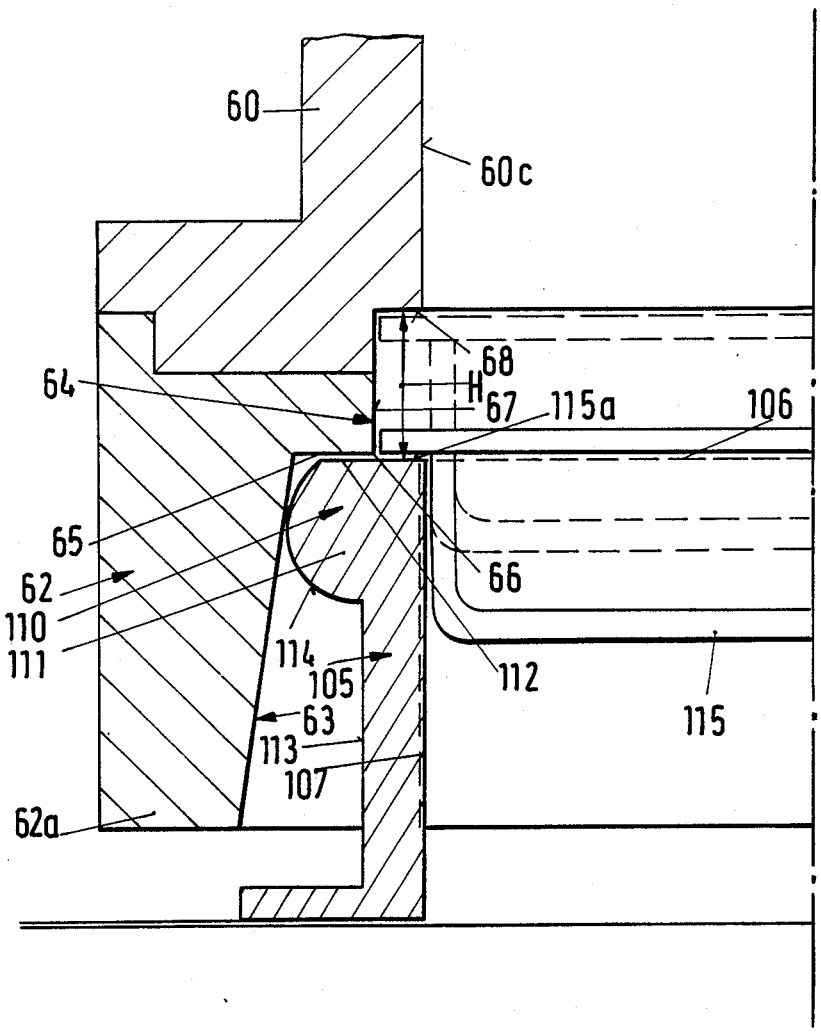
FIG. 3 shows, in an enlarged vertical partial section, the interaction of the centering ring of the screwing in and screwing out device for screw caps with the filler neck.
Figure 4:
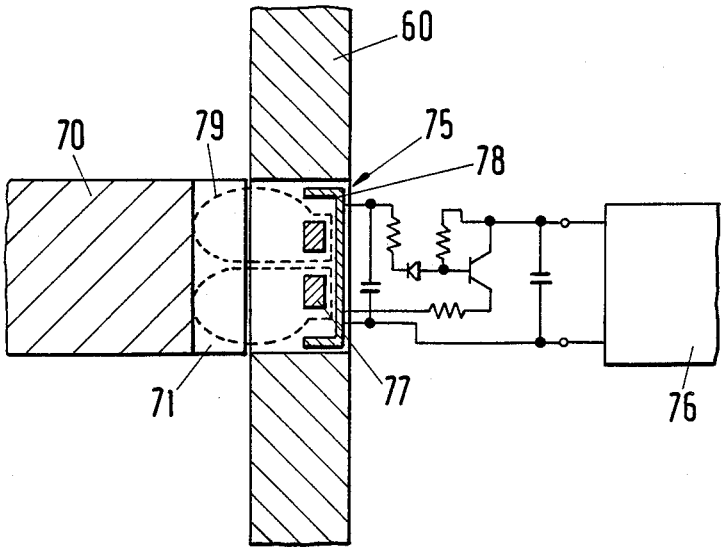
FIG. 4 shows a proximity switch in a diagrammatical representation.

In the embodiment shown in FIGS. 1 thru 3, the closing of the filling aperture 106 of filler neck 105 is effected by means of a screw cap 115 fabricated from plastic or some other suitable metallic material and which is provided with an inserted bottom, the circumferential wall section of the inserted bottom being provided with an outer thread 116, (FIG. 2). The configuration of the screw cap is such that the screw cap 115 can be screwed with its outer thread 116 into the inner thread 107 of the filler neck 105. In order to be able to seize the screw cap 115 for the screwing in or for the screwing out operation—which will be dealt with in greater detail in the following—the screw cap 115 is, within the inner space 117 formed by the inserted bottom, on the base of the screw cap 115, provided with engaging or entraining members indicated at 119, e.g. in the form of wing-like configured sections. However, it is also possible to screw in or to screw out differently configured screw caps or even screw plugs with the device 10 if these closure means are provided with an outer thread as well as with engaging or entraining members into which the corresponding facilities of the device 10 engage in order to be able to rotate the closure means around around their center axis for the screwing in and screwing out operation.

The screwing in and screwing out device 10 for screw caps comprises a centering and screwing head 120, an outer centering member 130, a wrench 140 which can be brought into operative connection with the screw cap 115 and a drive means 150 for the wrench 140.

According to FIG. 1, a supporting frame 30 is connected to a vertical supporting arm 20 that is perpendicularly displaceable in the direction of the arrow X with the aid of a driving mechanism not shown in the drawing in such a way that the same projects laterally relative to the supporting arm 20. However, the possibility also exists of attaching the supporting frame 30 on both sides to the supporting arms 20. The supporting arm 20 may also be additionally displaceable in the horizontal direction.

This supporting frame 30 is constructed as a supporting bracket 31. This supporting bracket consists of an upper horizontal annular member 32 and a lower horizontal member 33 disposed at a distance from the annular member 32 with the aid of spacer arms 34 and extending parallel to the annular member 32, the two central apertures of the annular members 32, 33 being identified with **32*a*, 33*a*. These two apertures 32*a*, 33*a* of the two annular members 31, 32 of the supporting bracket 31 correspond to one another. The diameter of the two apertures 32*a*, 33*a* of the annular members 32, 33 may be identical; however, the possibility also exists of dimensioning the diameter of the aperture 32*a* of the upper annular member 32 somewhat larger as compared to the diameter of aperture 33*a* of the lower annular member 33**.

This supporting bracket 31 accommodates the centering and screwing head 120 which—as will be described in greater detail in the following—is supported in the supporting bracket 31 so as to be pivotable around its longitudinal axis or movably, this centering and screwing head comprising a guide cylinder 40, the outer centering member 130 and the wrench 140, so that when the supporting arm 20 is vertically displaced with the supporting bracket 31, the centering and screwing head also participates in this operation. The two spacer arms 34 which keep the two annular members 32, 33 of the supporting bracket 31 at a distance from one another, are secured on the external circumferential area of the two annular members 32, 33. The outer diameters of the two annular members 32, 33 are identical.

In the two intercorresponding apertures **32*a*, 33*a* of the two annular members 32, 33 of the supporting bracket 31, the guide cylinder 40 is arranged which projects with a section on both sides from the plane formed by the two annular members 32, 33 (FIGS. 1 and 2). The upper end of the guide cylinder is identified with 40*a*, its lower end with 40*b* and its inner space with 40*c***.

Adjacent to its lower end **40*b*, the guide cylinder 40 has, on its outer wall surface, a circumferentially extending outer ring 41 which is constructed as supporting ring for a springily resilient component. The outer ring 41 forms a fixed part of the guide cylinder 40 which is constructed as a cylindrical pipe. The outer circumference of the outer ring 41 of the guide cylinder 40 is dimensioned in such a way that the outer ring 41 is supported upon the inner wall surface that faces the annular member 32 of the annular member 33 of the supporting bracket 31. In order to enable the guide cylinder 40 to be brought into any requisite inclined position, or to enable it to adapt itself to any tilting, the sectional area of the outer ring 41 of the guide cylinder 40 on the annular member 33 is constructed accordingly, this construction or configuration may, for example, be such that the outer, circumferentially extending bearing surface of the outer ring 41 is provided with an annular bead having a pitch-circular section, while the bearing surface of the outer ring 41 on the annular member 33 is provided with an appropriately configured annular recess so that a rolling off of the outer ring 41 with its bead-like external configuration can take place in the annular groove or groove-like recess in the annular member. In addition, there exists the possibility of constructing the annular member 33 to be springily resilient, so that if the annular member 33 is unilaterally loaded, this loaded section will be able to give way, e.g. in the direction of the arrow Y, that is to say that the annular member will be able to deflect into this area. In this type of construction the spacer arms 34 are likewise springily elastic so that a positional change of the annular member 33** in its section loaded by the guide cylinder 40 together with the spacer arms 34 relative to the rigid annular member 32 is possible.

The support and mounting of the guide cylinder 40 in the supporting frame 30 is effected with the aid of the springily elastic component which, in the mbodiment depicted in FIGS. 1 and 2, is constructed as a cylindrical coil spring 42 which surrounds the guide cylinder 40 so that the same comes to be disposed within the inner space of the coil spring 42. The top end of the coil spring 42 is identified with 42*a* and the lower end of the coil spring with 42*b*. This coil spring 42 is clamped between the upper annular member 32 of the supporting bracket 31 and the outer ring 41 of the guide cylinder 40 and this in such a fashion that the coil spring 42 comes to be supported with its top end 42*a* upon the inner wall surface of the upper annular member 32, and with its lower end 42*b*, upoin the outer ring 41 of the guide cylinder 40. In the supporting areas of the coil spring 42 on the annular member 32 and on the outer ring 41 of the guide cylinder 40, the annular member 32 and the outer ring 41 are appropriately sectionally configured so as to preclude a lateral deflection of the coil spring 42 with its top end 42*a* or with its lower end 42*b*. Due to this mounting of the guide cylinder 40 by means of the coil spring 42 in the supporting bracket 31, the guide cylinder 40 and all the components connected with the same and described in greater detail in the following, can be pivoted around the longitudinal axis of the guide cylinder, that is to say, the guide cylinder 40 can, with its bottom portion, be swivelled or displaced in the direction of the arrow X2 around, by way of example, the swivel point indicated at 45 in FIG. 2.

On its upper end 40*a*, the guide cylinder 40 is provided with a closing plate 46 which is detachably or rigidly connected to the surrounding wall of the guide cylinder 40. Mounted on this closing plate 46 is the drive means 150 for the wrench 140. In the embodiment shown in FIGS. 1 and 2, the drive means is constructed in a manner known per se as an air motor 50 which, for reversing the rotational direction of the drive shaft 53, is provided with two connections 51, 52. Motors operated by air pressure are known to exist in the most widely varying types and may be employed here as drive means 150, it being also possible, however, to employ differently constructed drive means, such as, for instance, electromotive ones or the like.

The drive shaft 53 of the air motor 50 is passed through an opening 47 in the closing plate 46 of the guide cylinder 40 as well as through the inner space of the same. The bottom free end of the drive shaft 53 carries the wrench 140. The drive shaft is constructed in a longitudinally displaceable manner, i.e. the drive shaft is constructed in such a way that it may be telescoped, which operation is effected in the direction of the arrow X1. In addition, the drive shaft 53 is acted upon by a coil spring 56 which surrounds the drive shaft 53 within the inner space area of the guide cylinder 40, and the top end 56*a* of which is supported on an upper cylinder support member 54 and, with its lower end 56*b*, on a lower supporting ring 55, the cylinder support member 54 and the supporting ring 55 being arranged at a distance from one another. It is by this distance that the drive shaft 53, which is constructed in two sections within this area, can be telescoped. The mode of operation of the coil spring 56 will be dealt with in greater detail in the following. The direction of rotation of the drive shaft 53 is indicated by the arrow X3.

The outer centering member 130 comprises a cylindrical hollow body 60 which is constructed so as to be open at both ends and which is arranged longitudinally displaceable within the inner space of guide cylinder 40. The dimensions of the cylindrical holow body 60 are such that the hollow body 60 is guided with its outer wall space on the inner wall space of the guide cylinder 40. At 80, a lifting stop for the cylindrical hollow body 60 is indicated which consists of a pin that is disposed in the wall of the guide cylinder 40 and which extends into the path of advance of the cylindrical hollow body 60. The outer wall surface of the hollow body 60 is provided with a longitudinal groove 81, into which the lifting stop pin engages, the lifting stop pin 80 prevents at the same time a possible turning of the cylindrical hollow body 60 around its longitudinal axis.

This cylindrical hollow body 60 is acted upon by a cylindrical coil spring 61 which is disposed above the hollow body 60 within the inner space 40*c* of the guide cylinder 40, to be more precise, abutting against the inner wall surface of the guide cylinder 40, this coil spring 61 being supported with its top end 61*a* on an annular insertion 48 on the upper end 40*a* of the guide cylinder 40, while the lower end 61*b* of the coil spring 61 is supported on the upper circumferentially extending rim of the hollow cylindrical body 60 (FIGS. 1 and 2).

On its lower end the cylindrical hollow body 60 is provided with a centering ring 62. This centering ring 62 may be constructed as a special structural unit and be connected to the hollow body 60 by means of bolted connections or the like. However, there also exists the possibility of constructing the bottom end of the cylindrical hollow body 60 in the fashion of a centering ring. The annular inner wall surface 63 of the centering ring 62 expands conically in the direction leading toward the bottom free end 62*a*, so that the inner wall surface 63 tapers conically in the upward direction (FIGS. 2 thru 3). This inner wall surface 63 of the centering ring 62 is placed upon the circumferentially extending rim 110 of the barrel filler neck 105, this circumferentially extending rim 110 is embraced or overlapped. In addition, the inner wall surface 63 of the centering ring 62 imitates the configuration of the rim 110 of the filler neck 105 of a barrel, container 100 or the like. For this purpose, the inner wall surface 63 of the centering ring 62 passes from the bottom end into a specially constructed contact surface 64 which consists of an upper horizontal annular section 65 which, while forming a step-like section 66, passes into a vertical annular surface 67 and a horizontal annular surface 68 into the inner wall surface of the cylindrical hollow body 60. The inner space surrounded by the centering ring 62 is indicated at 69 (FIG. 3).

The inner space of the cylindrical hollow body 60 and possibly also the inner space of the guide cylinder 40—since the cylindrical hollow body 60 is open at both ends—communicates with a vacuum-generating facility not shown in the drawing, with the assistance of which a vacuum is produced within the inner space of the cylindrical hollow body 60, so as to be able to, by means of said vacuum, pick up a screw cap 115 in order to retain the same on the wrench 140 for the screwing in operation. The wrench 140 disposed on the free end of the drive shaft 53 is constructed in such a way that the wrench 140 is able to engage into the engaging and entraining members 119 of the screw caps 115 so that, when the wrench 140 is turned to the right or to the left, the screw cap 115 is carried along for the screwing in operation or for the screwing out operation, respectively. The union for connecting the vacuum-generating facility is fitted into the wall of the cylindrical hollow body 60 and is identified with 90 in FIG. 2.

In order to monitor and control the screwing in depth and the screwing in torque of the screw caps 115, the drive shaft 53 for the wrench 140 is provided with a horizontal measuring disk 70, to be more precise, above the wrench 140, the distance from the measuring disk 70 to the lower end of the wrench 140 corresponds approximately to the length of the wrench 140. The outer diameter of the measuring disk 70, which assumes the position shown in FIG. 2, corresponds roughly to the internal diameter of the cylindrical hollow body 60 of the centering member 130, so that, when the wrench 140 is lowered or raised, the measuring disk 70 participates in this travelling movement in the direction of the arrow X6.

On its outer circumference, the measuring disk 70 is provided with a number of recesses such as notches, grooves or otherwise configured indentations 71 which are arranged spaced apart at equal distances. In the wall of the cylindrical hollow body 60 of the centering member 130, in the path of travel of the measuring disk 70, a proximity switch 75 is disposed which is constructed in a manner known per se and comprises a repeater circuit 76 with an oscillatory circuit coil 77 and a screening 78, the pattern of the field produced is indicated at 79. This proximity switch 75 is an electronic switching device which indicates whether metal parts have approached within a certain distance or not. Inductive proximity switches consist of an oscillator supplying the primary side of a transformer with voltage. The metal parts to be detected act as secondary side. An eddy current is induced when an approach takes place. This leads to a rise in the primary current which is registered at a certain threshold. A change in the output signal occurs thereby. An inductive proximity switch can be employed when the measuring disk 70 is fabricated from metallic materials. If, however, the measuring disk 70 does consist of non-metallic materials, as e.g. plastics, then it is advantageous if on the base areas of the individual recesses or indentations 71, on the periphery of the measuring disk 70, small plates of metallic materials are disposed, but even then the peripheral area of the measuring disk 70 must be provided with a metallic coating. Capacitive proximity switches respond to the approach of non-metallic materials and are employed when the measuring disk 70 does not consist of metallic materials.

The fitting of the proximity switch 75 into the wall of the cylindrical hollow body 60 is effected within the area adjoining the centering ring 62. There also exists the possibility of arranging the proximity switch 75 in a longitudinally displaceable fashion in the wall of the cylindrical hollow body 60, which is advantageous when screw caps 115 of different strengths are to be screwed in or screwed out.

The measuring disk 70 in connection with the proximity switch 75 is employed in such a way that when the drive means 150 is put into operation, the drive shaft 53 and thus also the wrench 140 are set into rotation. When screwing the screw cap 115 into the thread of the filler neck 105, and this while simultaneously and continuously lowering the wrench 140 due to the drive shaft 53 being biased by the coil spring 56, the measuring disk 70, too, is lowered slowly and thereby comes within the area of the proximity switch 75, whereby impulses are triggered which are utilized for control purposes via appropriate devices not shown in the drawing. Thereby an indication is supplied to the effect that the screwing in depth has almost been reached. The arriving impulses may, for instance, be evaluated in a computer and made use of for controlling the screwing in depth and screwing in torque required in each case. The air motor stops automatically when no more impulses are received. This means that the screwing in torque and, thereby, also the final screwing in depth has been reached. A monitoring of the screwing in torque is possible to be effected in this way.

The length of the vertical wall section 67 of the inner wall surface 63 of the centering ring 62 which tapers conically inside in the direction toward its end amounts to exactly the screwing in depth of the screw cap 115, i.e. 5 to 10 mm.

For the springily resilient suspension of the guide cylinder 40 on the supporting bracket 31, it is possible to provide, in lieu of the coil spring 42 surrounding the guide cylinder 40, several coil springs arranged at equal distances from oned another and preferably at a distance from the circumference of the guide cylinder 40 which, with their top ends, are supported on the upper annular member 32 of the supporting bracket 31, and with their lower ends, on the circumferentially extending outer ring 41 on the outer wall of the guide cylinder 40 so that these coil springs are arranged in an annular fashion around the guide cylinder 40.

In the place of a single coil spring **42*d* or of several coil springs annularly arranged around the guide cylinder 40, also differently constructed, springily resilient components may be employed. However, what matters really is that a construction and arrangement of these components are such that the guide cylinder 40 can be pivoted in the supporting bracket 31 in such a way that the guide cylinder 40 and thus the centering and screwing head 120 is capable of aligning itself to the longitudinal axis of the filler neck 105 preselected in each case. It is for this reason that the apertures 32*a*, 33*a* of the annular members 32, 33 of the supporting bracket are so dimensioned that the guide cylinder 40 is capable of swiveling around the, for example, swivel axis indicated at 45 in the direction of the arrows Y1, Y2, provided that the centering ring 62 is not seated upon the filler neck 105 of the barrel, container 100** or the like in order not to impair the bottom swivelling capacity in the direction of the arrow Y2.

The device for the screwing in and screwing out of screw caps functions as detailed below:

In order to screw a screw cap 115 out of the filler neck 105 of a barrel 100, the centering and screwing head 120 of the device 10 is brought into a position located above the barrel filler neck 105 by moving the supporting arm. This is followed by a lowering of the centering and screwing head 120 into the position depicted in FIGS. 1 and 2, in which the centering ring 62 overlaps the circumferentially extending rim 110 of the barrel filler neck 105 with its conical inner wall surface 63, as a result of which the conically extending inner wall surface 63 comes to rest upon the circular section 114 of the rim bead 111 of the barrel filler neck 105 (FIG. 3). In this position of the centering ring 62, its horizontal annular section 65 is supported on the mounting rim 112 of the rim bead 111 of the barrel filler neck 105. Due to the corresponding and dimensional configuration of the step-like section 66 of the inner wall surface 63 of the centering ring 62, a distance results between the horizontal annular surface 68 and the mounting rim 112 of the rim bead 111 of the barrel filler neck 105 which corresponds approximately to the height indicated with H in the FIG. 3. This distance H, during the screwing out of the screw cap 115 from the thread of the barrel filler neck 105, renders possible a raising of the screw cap 115 in such a way that subsequently, during a further raising of the centering and screwing head 120, while simultaneously carrying out a rotary motion of the screw cap 115 with the aid of the wrench 140 engaging into the screw cap 115 with a simultaneous starting up of the drive means 150, the screw cap 115 is screwed out of the thread of the barrel filler neck 105. During this operation the vacuum-generating facility is started so that a vacuum is produced within the inner space of the cylindrical hollow body 60 which renders possible a retention of the screw cap 115 on the wrench or by the sealing surface 68 and the laterally projecting and circumferentially extending wall surface 115*a* of the screw cap (FIG. 3). Hereby a sealing effect is simultaneously produced so that the screw cap 115 can be picked up by suction. This wrench 140 is constructed so as to resemble ahead at the bottom in oder to create a contact surface for the screw cap 115. The centering and the alignment of the centering and screwing head 120 or of the centering ring 62 on the circumferentially extending rim of the barrel filler neck 105 is effected by the interaction of the inner wall surface configuration of the centering ring 62 and the configuration of the circumferentially extending rim 110 of the filler neck 105. Since the centering and screwing head 120, relative to its longitudinal axis, is arranged variably in the supporting frame 30 or in the supporting bracket 31 and is acted upon by a spring, an automatic alignment of the centering ring 62 on the barrel filler neck 105 takes place even if the same were to fail to assume a vertical position to the barrel cover plate 101 of the barrel 100. Once the screw cap is lifted off from the thread of the barrel filler neck 105, then the centering and screwing head 120 is returned into its vertical starting position according to FIGS. 1 and 2 with the aid of the coil spring 42. During the screwing out operation of the screw cap 115, the wrench is in operative connection with the screw cap 115 and is set into rotation through the drive means 150 via the drive shaft 53. If the vacuum built up by means of the vacuum-generating facility within the inner space of the cylindrical hollow body 60 is cancelled when the centering and screwing head 120 is raised, then the screw cap drops off and can be removed. Should the centering and screwing head 120 have assumed an inclination for the screwing out operation, i.e. be tilted, then by means of the coil spring 42, an automatic alignment of the centering and screwing head 120 into the vertical is effected. The screwing out pressure during the lifting of the screw cap 115 is absorbed by the coil spring 56. When screwing in a screw cap 115 into the thread of a barrel filler neck 105, the coil spring 56 urges the wrench with the screw cap 115 picked up by vacuum-induced suction downwardly. The force of the coil spring 56 is in this case calculated in such a way that the thread of the screw cap 115 and the inner thread 107 of the barrel filler neck 105 are not damaged. During the upward travel of the centering and screwing head 120, the wrench is continued to be made to rotate in order to ensure that the screw cap 115 has been screwed out fully from the thread of the barrel filler neck 105, that is to say the drive of the wrench 140 is maintained for so long until the screw cap 115 is lifted off the barrel filler neck 105.

For screwing a screw cap 115 into an open filler neck 105, e.g. after the barrel 100 has been filled, the centering and screwing head 120 of the device 10 is moved into the area of the filler neck 105, as a result of which the cylindrical hollow body 60 with its centering ring 62 is pressed downwardly in the direction toward the filler neck 105 by means of the coil spring 61. In this operation the centering ring 62 is pressed against the circumferentially extending rim 110 of the filler neck 105. The hollow body 60 with the centering ring 62 is lowered as well at the same time, as a result of which, simultaneously with the setting into operation of the drive means 150, the drive shaft 53 with the wrench 140 revolves, by means of which the wrench 140 is acted upon by the coil spring 56. When overlapping the centering ring 62 of the circumferentially extending rom 110 of the barrel filler neck 105, the centering and screwing head 120 adapts to each respective position of the filler neck 105, even when the longitudinal axis of the barrel filler neck 105 does not extend to the vertical. By means of the coil spring 61, the outer centering member 130 is urged against the barrel filler neck 105, as a consequence of which the annular section 65 of the inner wall surface 63 of the centering ring 62 comes to rest upon the mounting rim 112 of the rim bead 112 of the barrel filler neck 105 or is pressed against this annular mounting rim 112, respectively.

Prior to the lowering of the centering and screwing head 120 onto the barrel filler neck 105, by the generation of a vacuum within the inner space of the hollow body 60, a supplied screw cap 115 has been picked up by suction which, when the centering and screwing head 120 is put down, is moved into the area of the barrel filler neck 105, a rough centering is effected first of all by the conical inner wall surface 63 of the centering ring 62. The main and fine alignment of the centering and screwing head 120 is then performed by the interaction of the specially configured contact surface 64 of the inner wall surface 63 of the centering ring 62 with the special configuration of the circumferentially extending rim 110 of the barrel filler neck 105, and this by the inclusion of the mounting rim 112 of the barrel filler neck 105 (FIG. 3). The lateral alignment of the centering and screwing head 120 is effected subsequent hereto by means of the conically tapering inner wall surface section on the circular section 114 of the circumferentially extending rim 110 of the barrel filler neck 105 while, by the interaction of the mounting rim 112 with the annular surface 65 of the inner wall 63 of the centering ring 62, the fine centering and adaptation to the barrel filler neck 105 is carried out. The vertical position to the barrel filler neck 105 is determined and defined by the vertical annular surface 69 of the inner wall 63 of the centering ring 62.

Once the alignment of the centering and screwing head 120 to the barrel filler neck 105 and its filling aperture 106 has taken place, then the wrench 140 is in engagement with the screw cap 115, is set into rotation for the screwing in operation, the procedure for the screwing in operation being that, to begin with, a short turn to the left is effected so that the screw cap 115 engages in the initial portion of the inner thread 107 of the barrel filler neck 105. Following this, the direction of rotation of the drive shaft 53 with the wrench 140 is reversed and, by a turn to the right, the screw cap is then screwed into the thread of the filler neck 105. The centering and screwing head 120 with the drive means 150 is arranged inside the spring 42 or suspended on the same for the sake of unimpeded movability.

What is claimed is:

1. A device for screwing and unscrewing caps into and from an internal thread of a filler neck attached to a cover plate and having a rim with an external rim bead comprising: a centering and screwing head having an outer centering member for mounting around onto the filler neck;

a rotatable and axially movable wrench within the interior of the head for engaging a screw cap;

drive means for driving the wrench;

a supporting frame forming a compartment and having openings; and a resilient component in said compartment; between said head and said supporting frame for holding said head relative said frame;

said centering and screwing head having a longitudinal axis;

the centering and screwing head and said drive means being arranged within the compartment of said supporting frame with sufficient clearance to move laterally relative to said frame and being held relative to said frame by said resilient component to allow said head and said drive means to travel laterally and axially relative to said frame.

2. A device according to claim 1, wherein the centering and screwing head is braced against said resilient component so as to be movable into any regular position which deviates from the longitudinal axis of the filler neck or into any position which coincides with the position that arises from a longitudinal axis of the filler neck which deviates from the vertical when the filler neck extends upwardly relative to the cover plane of the container, and so as to automatically resettable from any angular position into a vertical position.

3. A device according to claim 1, wherein said head includes a vertical supporting arm movable in the vertical direction and connected to the supporting frame and a guide cylinder passing through the supporting frame for carrying said drive means for the wrench, said drive means including a cylindrical, longitudinally displaceable hollow body having a lower centering ring mounted within the guide cylinder, said wrench being disposed within the cylindrical hollow body, a shaft connected to said wrench and forming a part of the drive means and arranged within the guide cylinder and the cylindrical hollow body of the centering member, said resilient means including a coil spring with two ends surrounding the guide cylinder supporting itself, at the one end, on the supporting frame and, at the other end, on the guide cylinder mounted in the supporting frame.

4. A device according to claim 3, wherein the vertically displaceable, perpendicular supporting arm includes a supporting bracket having an upper horizontal annular member and a lower annular member arranged at a distance from the upper annular member, said annular members having apertures which correspond to one another of the two annular members of the supporting bracket, the guide cylinder has a longitudinal axis and is disposed pivotably around its longitudinal axis, a surrounding outer ring adjacent to a lower end of the guide cylinder, said guide cylinder is supported upon the lower annular member and is biased by the coil spring which surrounds the guide cylinder, said spring supporting itself, at the lower end, on the outer ring of the guide cylinder and which, within the upper area, is supported on the upper annular member of the supporting bracket, wherein the coil spring is clamped between the upper annular member of the supporting bracket and the outer ring of the guide cylinder, said centering head an air motor with two connections for controlling the screwing and unscrewing of the cap and a vertical rotatable drive shaft for the wrench within the guide cylinder, said shaft is longitudinally displaceable against the pressure of the coil spring, the guide cylinder having an inner space with a cylindrical hollow body for acting as a centering member which is longitudinally displaceable in the longitudinal direction of the guide cylinder against the pressure of the coil spring, said centering member having a top and a bottom end and carrying on its bottom end a centering ring, said centering ring having an annular inner wall surface which expands conically toward the free end of the bottom end, wherein the upwardly tapering inner wall surface of the centering ring forms a contact surface on the circumferentially extending mounting rim of the filler neck and passes into an upper horizontal annular section, a step-like section with a vertical annular surface and a horizontal annular surface for joining the annular section and the inner wall surface of the cylindrical hollow body of the centering member, a vacuum-generating facility communicating with the centering member for picking up and retention of a screw cap on the wrench by means of a vacuum, the endwardly conically tapering inner wall surface of the centering ring is dimensioned so that when the centering ring is placed upon the filler neck of the container it overlaps the rim of the filler neck.

5. A device according to claim 4, wherein said head includes a horizontal measuring disk the drive shaft for the wrench supports, above the wrench, the horizontal measuring disk, the outer diameter of which corresponds to the inner diameter of the cylindrical hollow body of the centering member, the disk, on its outer circumference, including a number of recesses spaced apart at equal intervals, and a proximity switch in the wall of the cylindrical hollow body of the centering member, in the path of advance and motion of the measuring disk, for monitoring and controlling the depth and torque of the screws in operation.

6. A device according to claim 5, wherein the length of the vertical wall section of the inner wall surface of the centering which tapers conically in the direction toward its end on the inside, corresponds to the screwing in depth of the screw cap.

7. A device according to claim 4, wherein resilient member includes a plurality of coil springs arranged at equal distances from one another and at a distance from the circumference of the guide cylinder, said coil springs have top ends and bottom ends, and are supported, with their top ends, on the upper annular member of the supporting bracket and, with their lower ends, on the circumferentially extending outer ring on the outer wall of the guide cylinder.

8. A device according to claim 6, wherein the drive shaft of the wrench is constructed so as to be telescopically retractable and extendible for the purpose of changing its length.

9. A device according to claim 6, wherein the cylindrical hollow body of the centering member has a wall with a lower area, and the proximity switch for the measuring disk is disposed within the lower area of the wall of the cylindrical hollow body of the centering member.

10. A device according to claim 6, wherein the proximity switch is arranged vertically displaceably in the wall of the cylindrical hollow body of the centering member.

11. A device according to claim 6, wherein for a rolling off or rolling away of the outer ring of the guide cylinder on the annular member of the supporting bracket when transferring the guide cylinder from its vertical starting position into a tilting position, the outer ring within the area of its surface resting uppon the annular member, includes a rim bead possessing a circular cross-sectional profile which engages a appropriately configured counterprofile in the form of an annular recess or annular groove in the surface of the annular member.

12. A device according to 10 claim 11, wherein the annular member includes a springily resilient material possessing a resetting capability of returning the sidewardly bent portion of the annular body into its horizontal starting position when unilaterally loading the annular member means of the cylinder with the aid of its outer ring.

13. A device according to claim 11, wherein the annular member includes a resilient material having a resetting capability of returning the sideward bent portion of the annular member into its horizontal starting position when unilaterally loading the annular member by means of the guide cylinder with the aid of its outer ring and in that the two spacer arms linking the two annular members include a springily resilient material possessing a resetting capability for returning from a deflected position into their vertical starting position.

14. A device according to claim 12, wherein the two annular members have apertures dimensioned to be larger than the outer diameter of the guide cylinder.

15. A device for applying and removing threaded caps to and from threaded filler necks of containers, comprising:

a centering device having a longitudinal axis and a conical centering member for fitting over a neck;

a rotatable grasping member mounted within the centering device for grasping a cap and turning the cap to thread it relative to the filler neck;

a driver within the centering device for rotating the grasping member;

a frame surrounding the centering device; and resilient means in the frame for resiliently holding the centering device relative to said frame and permitting the centering device to move axially and radially relative to said frame; and said frame and said centering device having sufficent clearance between them to permit the axial and radial movement of said centering device relative to said frame.

* * * * *